United States Patent [19]

Smith et al.

[11] Patent Number: 4,988,097

[45] Date of Patent: Jan. 29, 1991

[54] COMBINATION EXERCISE AND REFRESHMENT DEVICE

[75] Inventors: Robert W. Smith, San Jose; John J. McIntyre, Foster City; Marland Chow, Huntington Beach, all of Calif.

[73] Assignee: Actiwear, Ltd., Mission Viejo, Calif.

[21] Appl. No.: 188,086

[22] Filed: Apr. 27, 1988

Related U.S. Application Data

[63] Continuation of Ser. No. 861,530, May 9, 1986, abandoned, which is a continuation-in-part of Ser. No. 681,671, Dec. 14, 1984, abandoned.

[51] Int. Cl.[5] ..... A63B 21/065

[52] U.S. Cl. ..... 272/119; 224/148

[58] Field of Search ..... 272/71, 93, 116, 119, 272/130; 137/510, 907; 224/148, 160, 164, 165, 170, 171, 219, 222, 224, 229, 267; 128/402, 403

[56] References Cited

U.S. PATENT DOCUMENTS

| | | | |
|---|---|---|---|
| 2,161,531 | 6/1939 | Rylsky | 137/510 |
| 2,235,350 | 3/1941 | Anderson | 224/148 |
| 3,160,158 | 12/1964 | Rayhart | 224/222 X |
| 3,242,942 | 3/1966 | Gould | 137/510 |
| 3,814,288 | 6/1974 | Westrich | 224/148 X |
| 4,139,130 | 2/1979 | Glusker et al. | 224/148 |
| 4,176,772 | 12/1979 | Danon | 224/148 |
| 4,265,381 | 5/1981 | Muscatell | 224/148 |
| 4,327,853 | 5/1982 | Adams | 224/222 X |
| 4,345,704 | 8/1982 | Boughton | 224/148 X |
| 4,351,526 | 9/1982 | Schwartz | 272/122 |
| 4,365,354 | 12/1982 | Sullivan | 2/171 X |
| 4,462,116 | 7/1984 | Sanzone et al. | 272/119 X |
| 4,517,685 | 5/1985 | Lesley | 2/170 |
| 4,602,784 | 7/1986 | Budden et al. | 272/119 |
| 4,736,876 | 4/1988 | Kriss | 224/148 |

FOREIGN PATENT DOCUMENTS

| | | | |
|---|---|---|---|
| 207330 | 11/1923 | United Kingdom | 224/165 |
| 1568081 | 5/1980 | United Kingdom | 272/119 |

*Primary Examiner*—Robert W. Bahr

*Attorney, Agent, or Firm*—Flehr, Hohbach, Test, Albritton & Herbert

[57] ABSTRACT

A combination exercise and refreshment device to be worn about a runner's or other athlete's wrist or forearm that contains liquid, the weight of which provides vigorous exercise to the muscles of the hands, arms and shoulders during the earlier part of the run or other aerobic exercise and the liquid serving to be drunk to replenish lost body fluids during the latter part of the exercise and reduce stress on the fatigued muscles comprising a liquid-containing pouch adapted to fit around the wrist, a fastener for attaching the pouch around the wrist, and a valve for introducing and withdrawing the liquid from the pouch directly into the user's mouth.

21 Claims, 7 Drawing Sheets

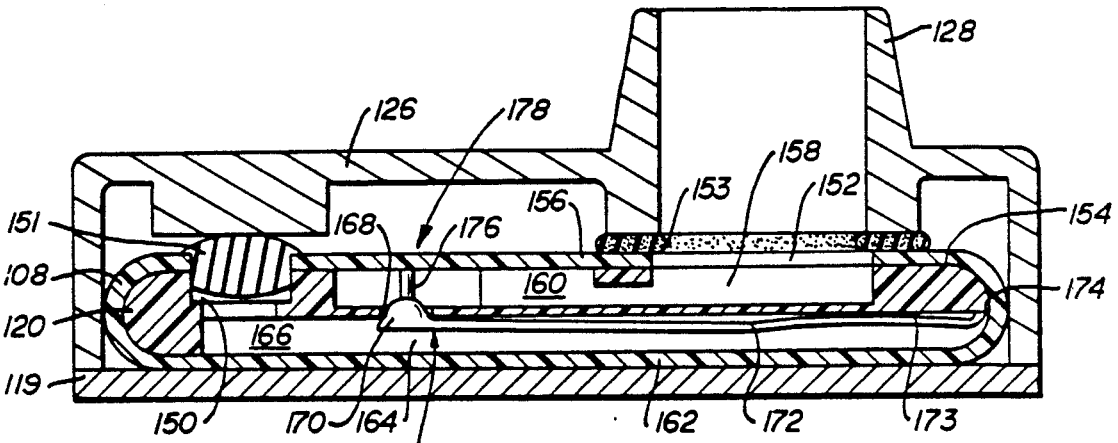
FIG._14.
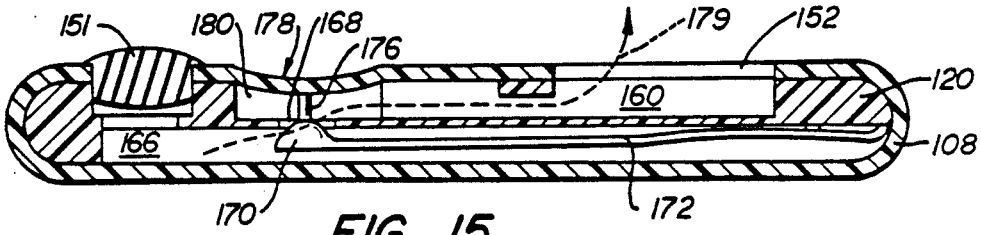
FIG._15.
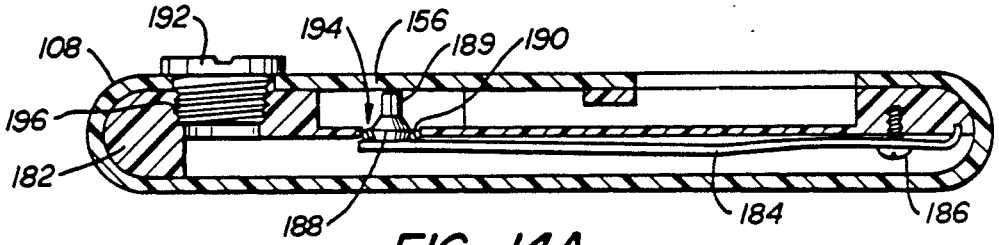
FIG._14A.
FIG._16.
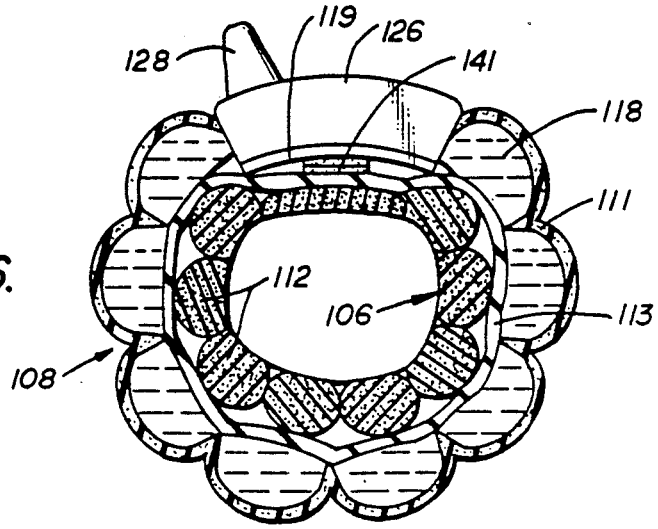

COMBINATION EXERCISE AND REFRESHMENT DEVICE

ORIGIN OF APPLICATION

This application is a continuation of prior application Ser. No. 861,530, filed May 9, 1986, now abandoned, which is a continuation in part of prior application Ser. No. 681,671, filed Dec. 14, 1984, in the name of Robert W. Smith, now abandoned.

BACKGROUND OF THE INVENTION

This invention pertains to the field of athletic appliances. More particularly, it pertains to exercise devices generally worn by runners and joggers but still applicable to other sports such as aerobic dancing, skiing and the like.

Recent findings indicate that while jogging and running are beneficial to the legs, heart, lungs and torso muscles, only minor benefits are imparted to the arms and shoulders. To remedy this, efforts have been directed to market small, hand-held weights and dumbbells and wrist weights to be carried or worn by the runner to more vigorously exercise the upper body, especially the shoulders and arms during the run. Such light weights are also used for "body sculpting" purposes during aerobic dance movements and routines. Such weights are not variable, but provide a constant amount of weight when used.

A major problem, however, has been encountered with these weights. The muscles in the legs and torso generally have more stamina than those in the arms. As jogging and running or other exercise proceed, the exerciser's shoulders, back and arms fatigue before he or she feels tired enough to stop. Thus, while the weight of the hand-held dumbbells provide beneficial exercise at the beginning of the run, they greatly overstress the fatigued arm, back and shoulder muscles after a period of time but before the run has ended. Also, hand held weights have been proven to cause back and neck strain. Wrist weights reduce and may eliminate this problem because they eliminate the pivot point of the wrist. Continuous upper body exercise, in conjunction with lower body exercise, particularly with weights added to the upper extremities, has been proven to burn proportionately more calories than lower body exercise alone. Thus, the ideal aerobic workout provides a high level of energy exertion while the body is fresh, then tapers off to a lower level of exertion for a larger time. Stressing fatigued muscles imparts little or no benefits thereto and may result in damage.

Another problem that has plagued running and all other athletic activities involving high levels of aerobic exertion is the continuous loss of body fluids from perspiration and heavy breathing. The runner literally dries out, and this condition brings on fatigue and muscle cramps, greatly reduces endurance, and can result in brain function problems due to a reduction in oxygen to the brain because of dehydration. The dry mouth and throat associated with this dehydration can cause discomfort that often shortens the period of exercise. Such dehydration also occurs in other activities such as aerobic dance, skating, skiing, and the like.

SUMMARY OF THE INVENTION

The principal object of the present invention is a device that overcomes the aforesaid problem with hand-held and non-variable wrist weights. In addition, the invention solves the long standing fluid-loss problem encountered during prolonged exercise. The device is a fluid-containing vessel, to be worn around the wrists or forearms. The weight of the fluid provides vigorous exercise to the shoulders and arms at the beginning of the run, when the muscles are strong and supple. The fluid can be poured out, or drunk to reduce the weight and stress on the wrists and arms without stopping the exercise, which replenishes body fluids or clears the runner's dry mouth and throat. The gradual reduction of the weight added to the upper body provided by this invention gives an ideal complement to the above theory of aerobic exercise, while rehydrating the athlete in the later stages of exercise.

In one embodiment of the invention, the vessel is housed in an elongated flexible pouch adapted to be wrapped around the wrist and fastened thereto. Fluid, at a temperature different from body temperature, may be maintained at that temperature by use of an insulation layer that encases the vessel in one form of the invention. Thus, the vessel can hold cold, refreshing water for the summertime athlete as well as hot, hearty tea or other hot beverage for the cold weather sportsperson.

Another object of the invention is to provide a means of carrying various quantities of liquid for refreshment in a device that does not interfere with sports activities and specifically with respect to running or jogging and the like, provides asymmetric weight on the extremities to enhance balance and maneuverability.

A still further object of the invention is to provide a means of absorbing perspiration in the area of the wrists and forearms to eliminate the tendency of the weights to slip and cause irritation to the skin.

It is still another object of the invention to provide an improved mouth actuated valve that is easily fabricated from molded plastic.

It is another object of the invention to provide a valve which is opened by means of suction applied by the user's mouth.

It is still another object of the invention to provide a wrist liquid carrying package incorporating such a valve.

These and related objects may be achieved through use of the novel variable weight arm and shoulder exercise and personal refreshment device and valve herein disclosed. In one form of the invention, the device has a liquid tight container dimensioned and configured to encircle a user's wrist. The liquid tight container has an outer wall. A valve is mounted on the outer wall and extends through the outer wall to communicate with an interior of the liquid tight container. A mouthpiece is provided at the valve to receive liquid through the valve. The valve is movable between an open and a closed position through application of force by the user's mouth on the mouthpiece. An expandable resilient band is attached to the liquid tight container. The expandable resilient band is dimensioned and configured to encircle the user's wrist beneath the liquid tight container. The band fixedly attaches the liquid tight container in place encircling the user's wrist free of adjustment as liquid is withdrawn from the container through the valve and mouthpiece by the user, i.e., as the liquid volume decreases and the container is depleted.

In another form of the invention, a semi-rigid container of curved shape is configured to fit around the wrist or forearm of the user. The semi-rigid container terminates at opposed ends that converge in close proximity to hold the container in place, and preferably includes a means for holding the container in place by interconnecting the opposed container ends. A mouth actuated valve is provided on the semi-rigid container as in the first form of the invention.

A valve in accordance with this invention includes a valve housing, with first and second chambers formed in the housing. A spout is connected to the first chamber. An orifice interconnects the first and second chambers. The second chamber is configured for connection to a body of liquid in a container. A normally closed valve member sealingly engages the orifice. The normally closed valve member is configured and positioned so that suction applied to the spout will move the normally closed valve member out of engagement with the orifice. This allows liquid in the container to pass through the first and second chambers to the spout.

The attainment of the foregoing and related objects, advantages and features of the invention should be more readily apparent to those skilled in the art, after review of the following more detailed description of the invention, taken together with the drawings, in which:

BRIEF DESCRIPTION OF THE DRAWINGS

FIG. 14 is a cross section view, taken along the line 14—14 in FIG. 11.

FIG. 14A is a cross section view corresponding to the cross section of FIG. 14, but of a fourth embodiment of the invention.

FIG. 15 is another cross section view, as in FIG. 14, but with the third embodiment in a different operating position.

FIG. 16 is a partial cross section view of a fifth embodiment of the invention.

DETAILED DESCRIPTION OF THE INVENTION

Figure 1:
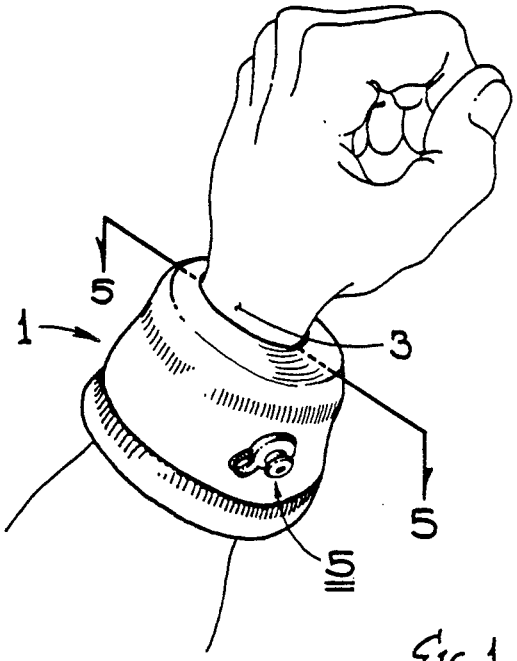
FIG. 1 is a perspective view of one embodiment of the device of this invention showing it in position about an athlete's wrist.
Figure 2:
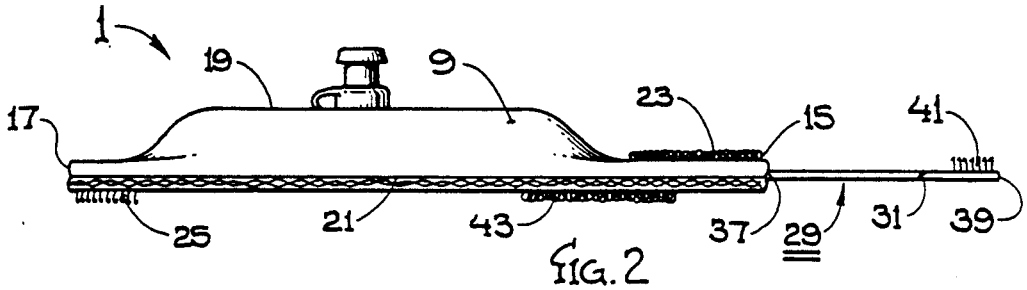
FIG. 2 is a side plan view of one embodiment of the device
Figure 3:
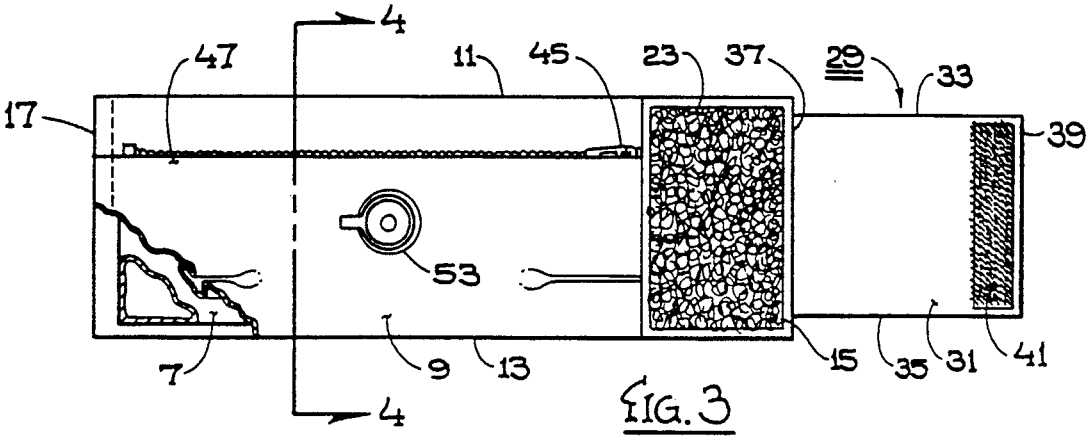
FIG. 3 is a top plan view of the embodiment shown in FIG. 2.
Figure 4:
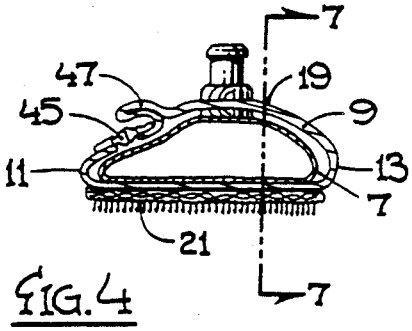
FIG. 4 is a sectional end view taken along lines 4—4 through the embodiment shown in FIG. 3.

Referring to the drawings where like elements are identified with like numerals throughout the 25 figures, a device 1 is shown in FIG. 1 wrapped about a wearer's wrist 3 in a position as it is designed to be worn during running, jogging, skiing, aerobic dance and the like. A means 5 is mounted on the outside thereof in a location easily accessible to the wearer's mouth for sucking liquid from device 1 as will be hereinafter more fully described. Device 1 is shown in FIGS. 2, 3 and 4 to comprise an elongated flexible liquid-containing bag or vessel 7 contained in an elongated flexible pouch 9 having substantially parallel sides 11 and 13, opposed ends 15 and 17, and a top 19 and bottom 21.

At ends 15 and 17 are located a means for holding bag 7 and pouch 9 in a fixed position adjacent the wrist or forearm comprising a wide strip 23 of loop Velcro TM sewn across the top of end 15 and a narrower strip 24 of Velcro hooks sewn across the bottom of end 17. In addition, there is provided a separate means 29 for retaining pouch 9 tightly adjacent the wrist or forearm as bag 7 is drained of liquid. Means 29 comprises a high tensile elastic strap 31 of terminal length, adapted to encircle a substantial part of the wrist or forearm, having opposed sides 33 and 35 and opposed ends 37 and 39 wherein end 37 is sewn or anchored to pouch end 15 and end 39 terminates in a narrow strip 41 of upwardly facing Velcro hooks material. A wider strip 43 of Velcro loops material is sewn across pouch bottom 21 slightly in from pouch end 15. To apply device 1, the wearer initially stretches and wraps elastic strap 31 about the wrist or forearm and engages Velcro strips 41 and 43. Pouch 9 containing bag 7 is then wrapped about the wrist or forearm over strap 31 and Velcro strip 25 pressed against strip 23 to interconnect them. Liquids may now be introduced into bag 7 or withdrawn therefrom and device 1 will remain securely in place. The preferred method is to fill bag 7 with liquid, insert the filled bag 7 into the flexible pouch 9 and then place it about the wrist or forearm.

It is preferred that bag or vessel 7 be replaceable in pouch 9 for filling, cleaning or replacing. A zipper 45, or other closing device, is sewn longitudinally in pouch top 19 to effect such a replacement. Zipper 45 is conveniently shielded by locating it in an expandable fold 47 extending along it that also serves to permit pouch 9 to expand as vessel 7 is filled with liquid.

Figure 5:
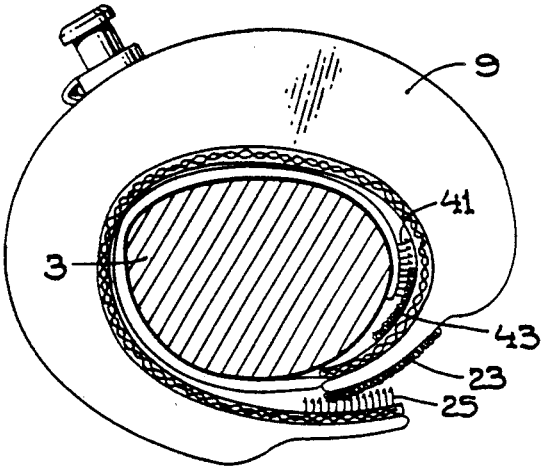
FIG. 5 is a side view of the device shown in wrapped configuration about an athlete's wrist taken along the lines 5—5 in FIG. 1.

FIG. 5 shows in cross-section and in somewhat exaggerated view how device 1 is worn about the wrist. First, elastic strap 31 is stretched and wrapped about the wrist or forearm and Velcro strip 41 pressed into engagement with Velcro strip 43. Then pouch 9, containing bag 7, is wrapped over strap 31 and Velcro strip 25 pressed into engagement with Velcro strip 23. As liquid is added to or drained from bag 7, pouch 9 expands and contracts yet remains stabilized against the wrist or forearm.

Figure 6:
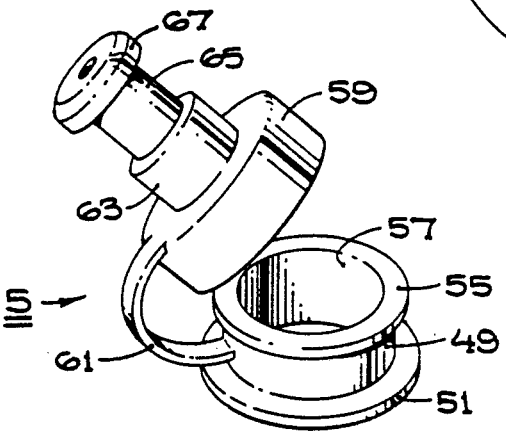
FIG. 6 is a perspective view of one of the means to introduce liquid into and withdraw it from the device.

Means 5 on top surface 19 is to introduce fluids into vessel 7 and/or to remove them, either to pour out or to be sucked into the user's mouth. They can be separate means but there already exist devices in the art that accomplish both functions. As shown in FIG. 6, means 5 comprises a hollow stub 49, having a bottom skirt 51 extending outward therefrom for attachment about an aperture formed in bag 7 adjacent pouch top 19, that passes outwardly through an aperture 53 formed in pouch top 19, and terminates in a slightly enlarged top rim 55. Hollow bore 57 formed in stub 49 communicates the interior of bag 7 with the outside. A cap 59, attached to stub 49 via a flexible arm 61 is adapted to snap tightly over rim 55 in sealing engagement therewith. A valve 63 is contained in cap 59 and includes a valve stem 65 reciprocally mounted therein that is adapted to open said valve when pulled upwardly, such as when the user pulls on rim 67, formed at the outer terminal end of stem 65, with teeth or lips, and to close when pushed inwardly. Thus, cap 59 may be pulled from stub 49, liquid added to vessel 7, the cap replaced and thereafter the liquid withdrawn at will by the wearer through movement of valve stem 65.

Figure 7:
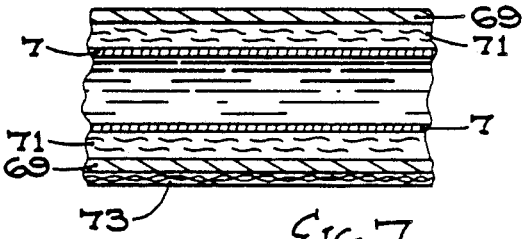
FIG. 7 is a sectional side view taken along lines 7—7 through the embodiment shown in FIG. 4.

FIG. 7 shows one embodiment of device 1 in cross-section. Shown is an outer layer 69 of abrasion resistant material such as woven nylon; an optional inner layer 71 of thermal insulation such as polymeric foam, to isolate the temperature of the contained liquid from both the wearer's body temperature and the ambient temperature to maintain a specific temperature (hot or cold) as in a Thermos bottle; and then vessel 7 that is composed of hygenically acceptable flexible material of sufficient thickness to withstand rough handling. A layer 73 of perspiration-absorbing material, such as terry cloth, may be attached to pouch bottom 21 for interposition between pouch 9 and the contact area of the wearer's wrist or forearm adjacent strap 31.

Figure 8:
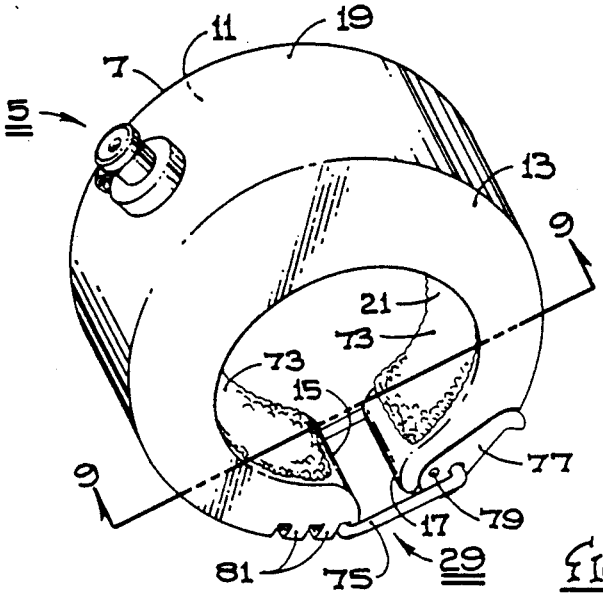
FIG. 8 is a perspective view of another embodiment of the device.
Figure 9:
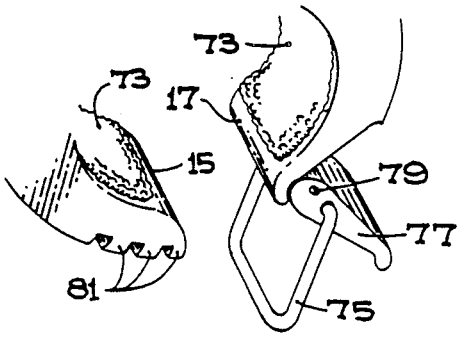
FIG. 9 is a close-up perspective view of the fastening means shown below lines 9—9 through the embodiment shown in FIG. 8.

FIG. 8 shows another embodiment of device 1 wherein vessel 7 is a semi-rigid or rigid molded container of a shape convenient to wear around the wrist, comprising opposed ends 15 and 17, sides 11 and 13 and top 19 and a bottom 21, said bottom covered by terry cloth layer 73. Means 29 is located at ends 15 and 17, for securing said ends together and device 1 about the wrist. As shown in FIG. 9, means 29 comprises a U-shaped bail 75, pivotally suspended at its ends from a latch 77 that is pivotally mounted at 79 to vessel end 17 in a manner such that swinging latch 77 causes bail 75 to move toward and away from end 15. Bail 75 is adapted to engage spaced-apart teeth or lugs 81 on end 15 so that swinging latch 77 toward its own end and past or through an imaginary line between teeth 83 and pivotal latch axle 79 will lock ends 15 and 17 together.

Figure 10:
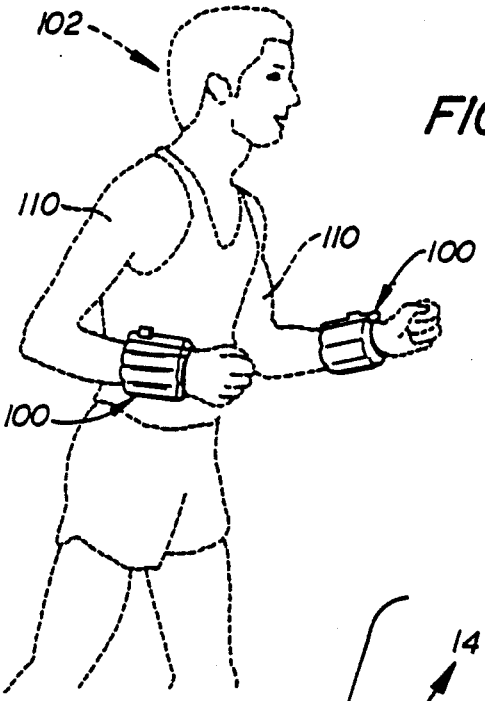
FIG. 10 is a perspective view of a third embodiment of the invention in use.

FIGS. 10–14 and 15 show a third form of a variable weight arm and shoulder exercise and personal refreshment device 100 in accordance with the invention. FIG. 10 shows how a pair of the devices 100 are worn by a runner 102 to serve as both a replacement for hand held or wrist weights while exercising and a source of refreshment. The devices 1 shown in FIGS. 1–9 are also typically worn in pairs in this manner. In some situations, the user may desire to wear only a single one of the devices 1 or 100. For example, a soccer referee might wear one of the devices 100 while officiating, or a racquet-sport player can wear one of the devices on the unencumbered arm. The device 100 incorporates a stopwatch 104, so that the referee would have both the stopwatch 104 on his wrist and a source of water or other refreshment available during the game without interrupting concentration on the game.

Figure 13:
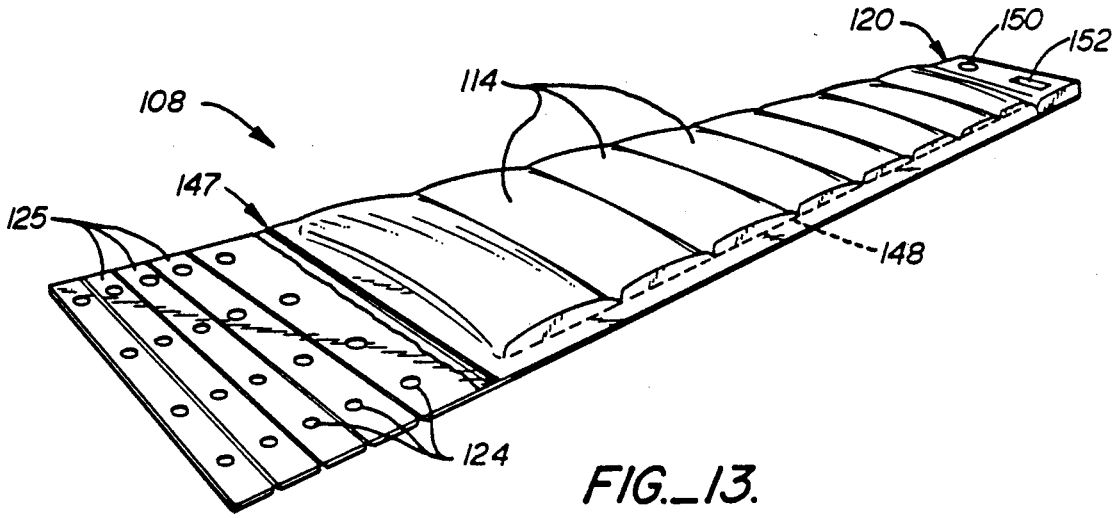
FIG. 13 is a perspective view of a portion of the third embodiment shown in FIGS. 10–12.

The device 100 has an inner, cylindrical sleeve 106, which fits around the wearer's wrist. An outer bag 108 for holding the water or other liquid refreshment encircles the cylindrical sleeve 106. The cylindrical sleeve 106 is neoprene or other elastic material in order to fit wrists of different size and hold the device 100 in place against slipping during movement of the wearer's arms 110 during running or other exercise. The cylindrical sleeve 106 is formed with a plurality of tufts or sponges 112, which are compressed when the outer bag 108 is full and the device 100 is tightened down in place on a user's wrist. As the bag 108 is emptied during use of the device 100, the sponges 112 expand as there is less liquid in the bag 108, thus helping to keep the device 100 from shifting on the user's wrist. The outer bag 108 has a plurality of tufted, interconnected compartments 114 for the liquid, for keeping the liquid uniformly distributed about the wrist or arm, regardless of amount, and for keeping the liquid from shifting about in the bag 108 as the user's arms are moved. Cushioning material 116 in the cylindrical sleeve 106 increases the comfort of the device as worn by the user 102. The outer bag 108 is secured in place around the sleeve 106 by means of a support plate 119 and valve housing 120. The support plate 119 has two rows of posts 122 extending upward to engage mating holes 123 on the valve housing 120 and holes 124 on each end of the outer bag 108. As shown in FIG. 13, the outer bag 108 is furnished with a plurality of tear-off strips 125 along one end, with each of the tear-off strips having a set of the holes 124. This allows the user to adjust the size of the outer bag 108 to fit smaller wrists, by tearing off one or more of the tear off strips 108 to the desired size. The posts 122 also engage holes 127 in a removable cover plate 126 in a friction fit. The cover plate 126 has a mouthpiece 128 used by the athlete 102 to withdraw water 118 from the outer bag 108 through valve 130 in the valve housing 120. The cover plate 126 also includes a display 132 for the stopwatch 104, electronics module 134 for driving the display 132, a battery 136 for powering the electronics 134 and display 132 and control buttons 138 for operating the stopwatch/timer 104. In addition to its use as a stopwatch, the display 132 and electronics 134 can provide other functions, as well. For example, with suitable circuits in the module 134 and a sensor (not shown) for engaging the user's skin, a pulse rate counter can be incorporated in the device 100. Other circuits can be provided in an optional, additional circuit module 135 for an FM radio or other electronic functions, also utilizing the display 132 for conveying information to the user Since the user 102 typically wears two of the devices 100, each of the devices 100 can incorporate different electronic functions, if desired, so that the user will have a variety of such functions available.

The cylindrical sleeve 106 is attached to the support plate 119 and valve housing 120 by a row of snaps 140, which fit into mating recesses 142 along the underside of the support plate and valve housing 120. The cylindrical sleeve 106 has a plurality of axially extending pockets 144 on its side adjacent the cushioning layer 116, for holding flat weights 146, which may optionally be inserted in some or all of the pockets 144 for increasing incrementally the weight of the device 100. Other objects, such as keys or money, may be inserted in the pockets 144. The pockets are closed with mating Velcro strips, overlapping folds or other suitable closures. Retroreflective strips 145 are attached to the outer surface of the outer bag 108.

The outer bag 108 has an opening 147, for example, formed with an interlocking ridge and groove structure of the type employed on Ziploc (Trademark of The Dow Chemical Company) plastic bags and described in U.S. Pat. Nos. 3,198,228 and 3,338,285. Passages 148 along the sides of the outer bag 108 interconnect each of the tufts 114 with each other and with the opening 147 to provide uniform containment and flow of liquid throughout bag 108. The opening 147 is used to fill the bag 108 with water or other suitable liquid rapidly with the device 100 disassembled. A second opening 150 having a snap on cover 151 is provided for filling the device 100 while it is assembled, by removing the cover 126.

Figures 17, 18, 19, 20, 21, 22:
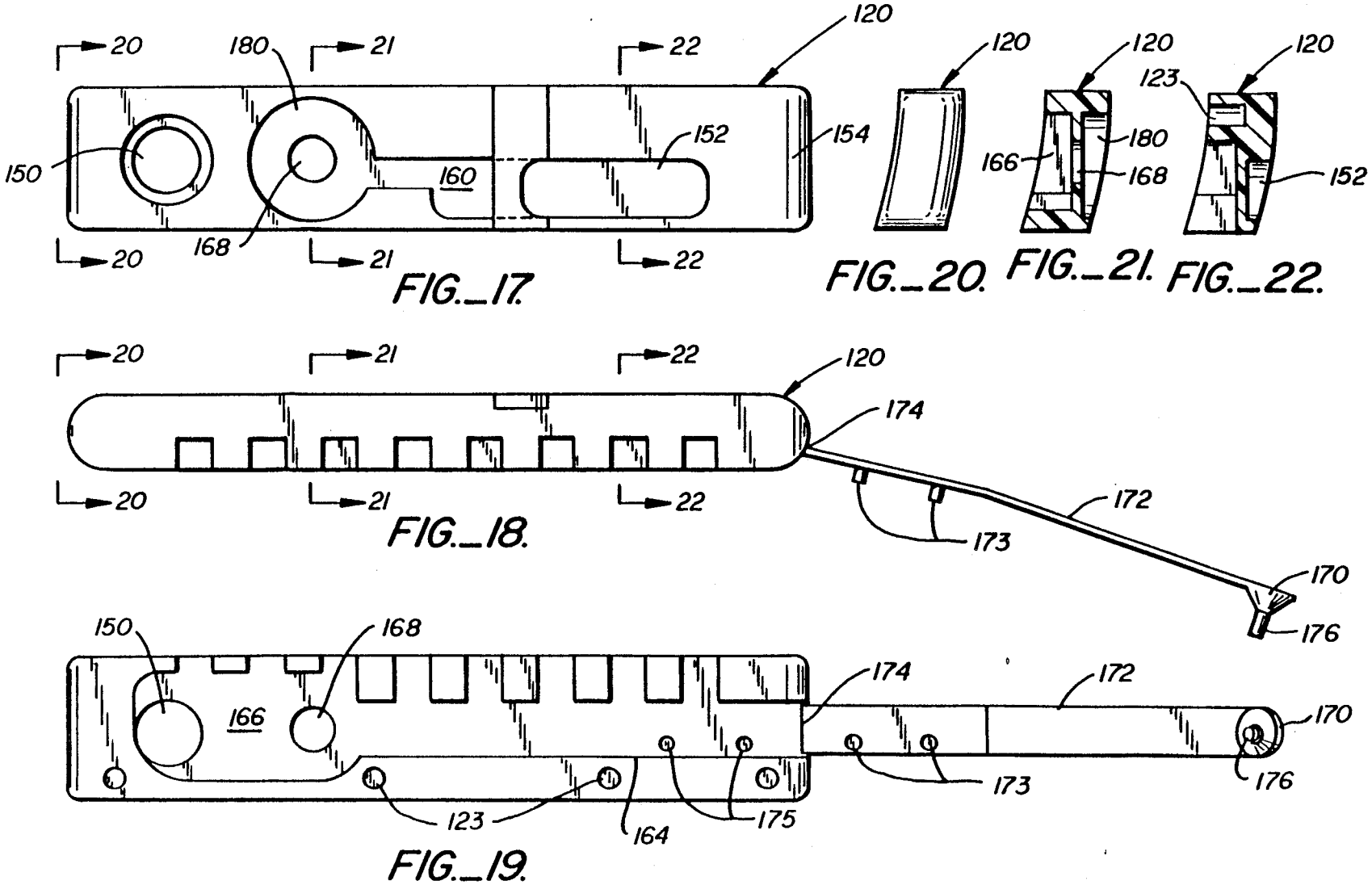
FIGS. 17, 18, 19 and 20 are top, front, bottom, and side views, respectively, of a portion of the FIGS. 10–14*a* and 15–16 third embodiment of the invention.
FIG. 21 is a cross section view taken along the line 21—21 in FIG. 17.
FIG. 22 is a cross section view taken along the line 22—22 in FIG. 18.

Details of valve housing 120, including the structure of valve 130, are shown in FIGS. 14, 15 and 17–22. Mouthpiece 128 on the cover 126 is positioned over opening 152 on upper surface 154 of the valve housing 120 and through upper wall 156 of the outer bag 108, which fits over the valve housing 120. A gasket 153 seals the mouthpiece around the opening 152. The housing 120 is shown inside the outer bag 108 in FIGS. 14 and FIG. 15 and alone in FIGS. 17–22. The upper wall 156 of the bag 108 and cavity 158 of the housing 120 form an upper chamber 160 within the housing 120. Lower wall 162 of the bag 108 and cavity 164 in the housing 120 form a lower chamber 166 within the housing 120. An orifice 168 communicates between the lower chamber 166 and the upper chamber 160. A valve member 170 is joined to the housing 120 by an arm 172, hinged to the housing 120 at 174 (see especially FIGS. 18 and 19), and further attached to the housing 120 by pins 173 in holes 175 when the arm 172 is folded over from the position as molded to the position shown in FIG. 14. As is best shown in FIGS. 18 and 19, the valve member 170 and arm 172 are integrally formed with the housing 120, for example, in a single molding step, and folded under the housing 120 to the position shown in FIGS. 14 and 15. Arm 172 acts as a spring to supply biasing force urging the valve member 170 in sealing engagement against the orifice 168. Tip 176 of the valve member 170 extends upward to terminate just short of the upper wall of outer bag 108 when the outer bag 108 and the housing 120 are assembled.

FIG. 15 shows how the valve member 170 is moved out of sealing engagement with the orifice 168 to open the valve. When the athlete 102 sucks on the mouthpiece 128, a partial vacuum is created in the upper chamber 160, which draws the upper wall 156 of the outer bag 108 downward at portion 178, where it overlies portion 180 of the upper chamber 160. The portion 178 of the upper wall 156 then applies downward force on tip 176 to move the valve member 170 to the position shown in FIG. 15, allowing the athlete 102 to suck water from the outer bag 108 through the lower chamber 166, orifice 168, upper chamber 160 and mouthpiece 128 in a flow path 179. When the athlete ceases sucking on the mouthpiece 128, portion 178 of the upper wall 156 moves upward to the position shown in FIG. 14, and the arm 172 urges the valve member 170 back into sealing engagement with the orifice 168. Closing the valve in this manner prevents air from entering into the outer bag 108 to replace water 118 removed from the outer bag 108 when suction is no longer applied to keep the valve open. Such air in the bag 108 might be ingested by the user in place of the desired liquid in subsequent attempts to drink from the device, and it would also contribute to sloshing of the liquid inside the bag.

FIG. 14A shows another embodiment of a housing 182 inside the outer bag 108. A separate metal arm 184 is fastened to the housing 182 by screw 186 to join valve member 188, which is integrally formed with the arm 184 and tip 189, to the housing 182. An 0-ring 190 is provided at the orifice 168 to ensure a good seal between orifice 194 and the metal valve member 188. A screw cap 192 is employed to seal the opening 196 in the housing. Upper wall 156 of the outer bag 108 engages the tip 189 in the same manner as tip 176 in the FIG. 15 embodiment. Other than as shown and described, the construction and operation of the FIG. 14 embodiment is the same as the FIGS. 10–14, 15 and 16–22 embodiment.

Figure 11:
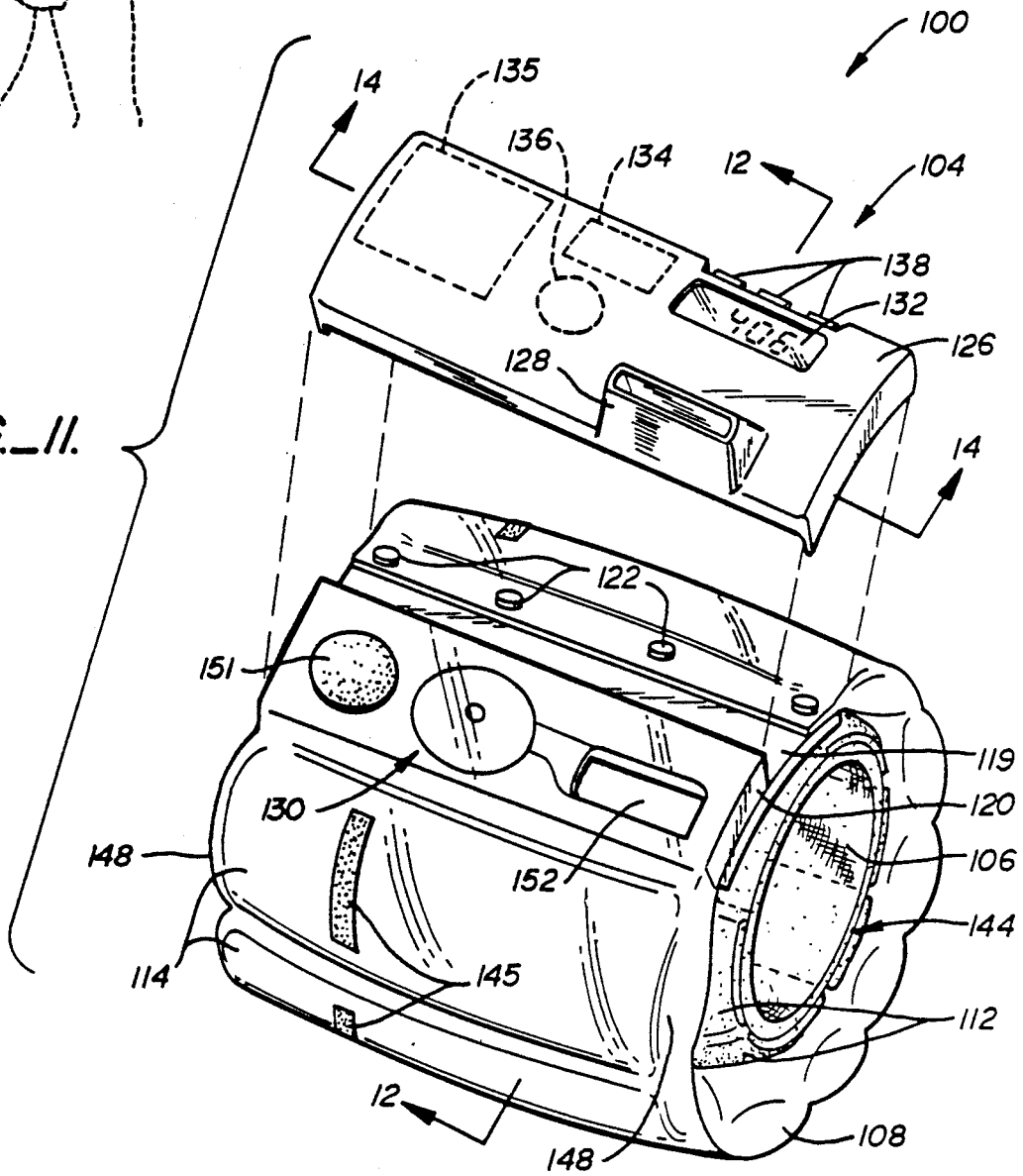
FIG. 11 is a partially exploded perspective view of the third embodiment of the invention.
Figure 12:
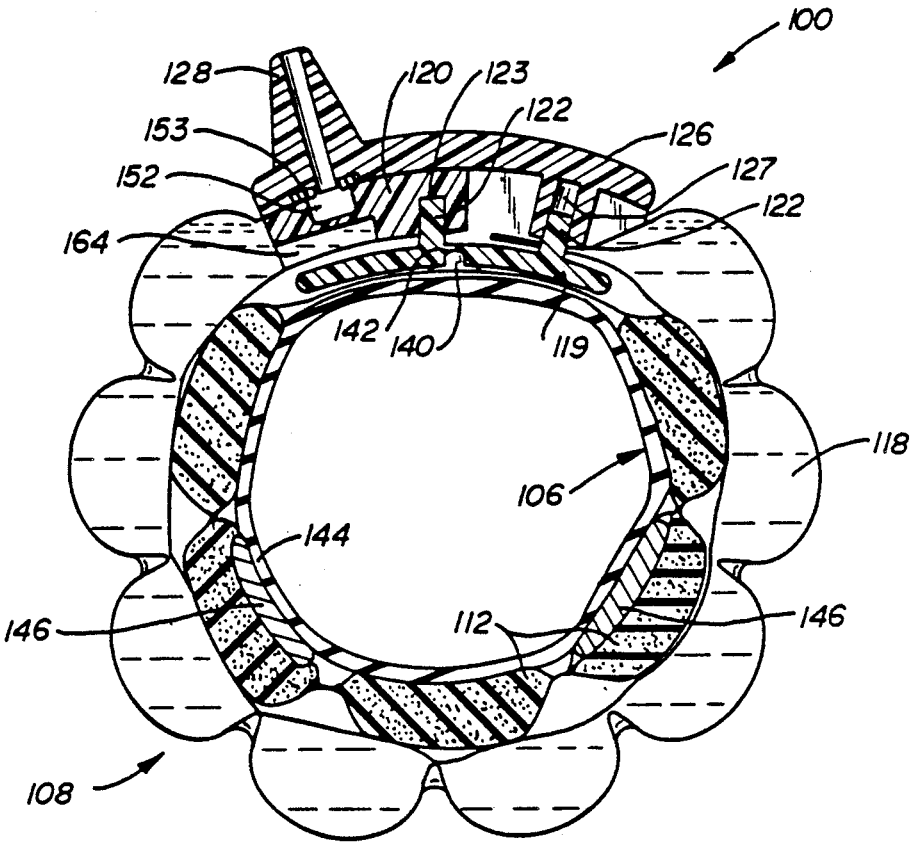
FIG. 12 is a cross section view taken along the line 12—12 in FIG. 11.

FIG. 16 shows another embodiment of a device in accordance with the invention in which the support plate 119 is fastened to the cylindrical sleeve 106 by means of mating Velcro strips 141 in place of the snaps 140 and recesses 142 in the FIG. 12 embodiment. This embodiment also includes an inner insulating layer 113 and an outer insulating layer 111, both desirably formed from Thinsulate fabric, on the outer bag 108 to help maintain the fluid 118 inside the bag 108 at a desired temperature different than ambient. An outer fabric layer could also be used, with or without the insulating layers, on the outside of the outer bag 108 for decorative effect. Other than as shown and described, the construction and operation of the FIG. 16 embodiment is the same as the FIGS. 10–14 and 15 embodiment.

Figure 23:
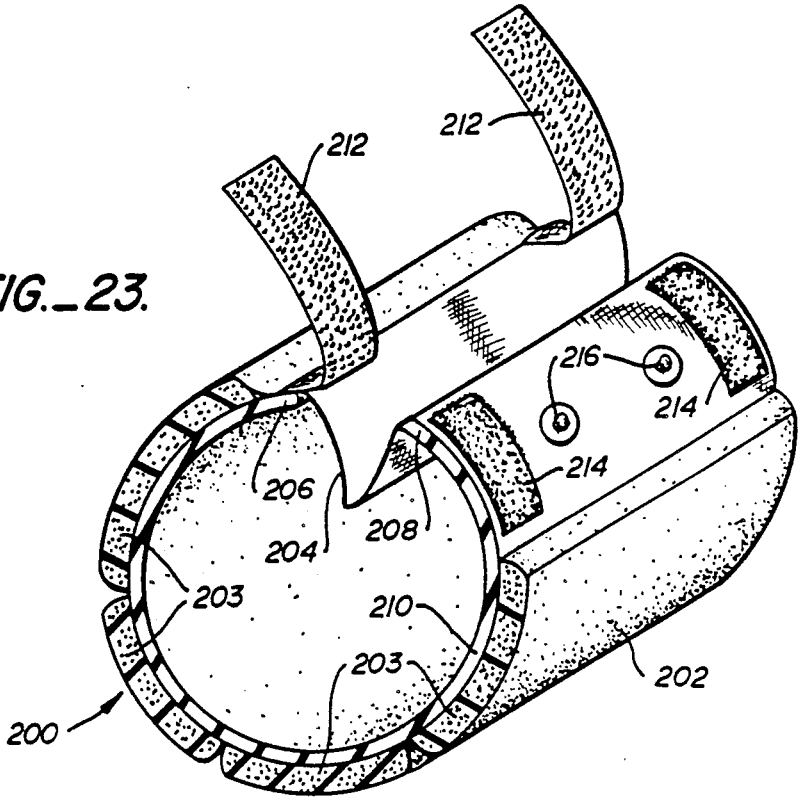
FIG. 23 is a perspective view of a portion of a sixth embodiment of the invention.

FIG. 23 shows another form of a cylindrical sleeve 200 that can be employed in place of the sleeve 106 in FIGS. 11–12 and 16. In the sleeve 200, outer Lycra fabric layer 202 extends over sponges 203 and has a fold 204 of extra length between ends 206 and 208 of neoprene cushioning layer 210. Mating Velcro hook strips 212 and loop strips 214 are attached to the fabric layer 202 at opposite sides of the extra length fold 204. The purpose of the extra length fold 204 is to allow the sleeve 200 to be slipped over the user's hands more readily. The fold 204 also allows the sleeve 200 to accomodate a larger range of wrist sizes.

In use, the user slips the sleeve 200 over his or her hands with the Velcro strips 212 and 214, then fastens the strips 212 and 214 together to take up the extra length portion 204 and fix the sleeve in place at the wrist or lower arm. A base plate is then attached to the sleeve 200 by means of the snaps 216, and an outer bag and cover plate are attached to the base plate as in the FIGS. 11–16 embodiments.

Figure 24:
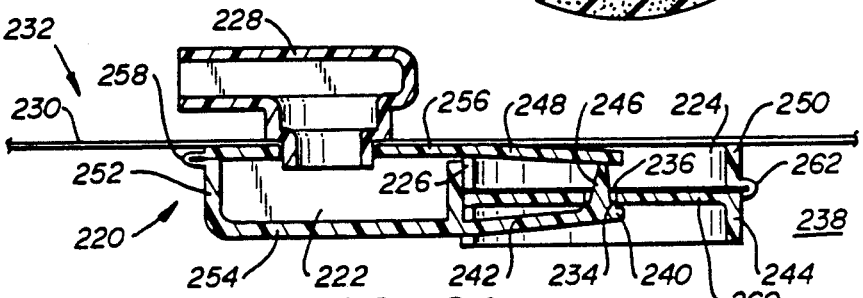
FIG. 24 is a side cross section view of a valve in accordance with the invention.
Figure 25:
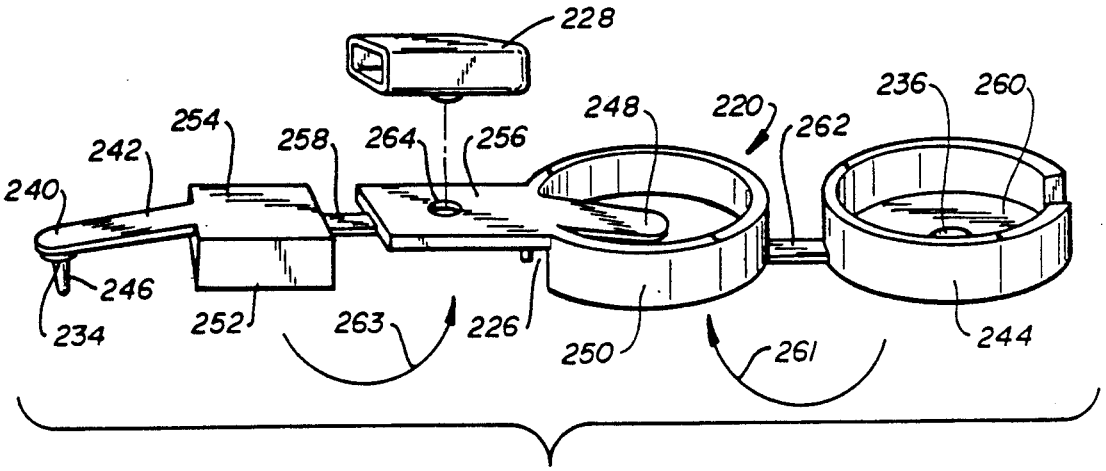
FIG. 25 is an exploded perspective view of the valve in FIG. 24.

FIGS. 24–25 show another form of a normally closed valve 220 that can be used in place of the normally closed valve 130 in the FIGS. 11–22 embodiments. The valve 220 has first and second chambers 222 and 224 that are laterally interconnected by a passage 226. A mouthpiece 228 extends through wall 230 of an outer bag 232 of an exercise and refreshment device of the type shown in FIGS. 11–16. A normally closed valve member 234 engages valve orifice 236 extending between interior 238 of the outer bag 232 and the chamber 224. The valve member 234 is attached to end 240 of resilient strip 242. The strip 242 extends from wall 244 of the valve 220 to the orifice 236. The valve member 234 has a tip 246 that extends through the orifice 236 to engage a second resilient strip 248. The second resilient strip 248 extends from wall 250 of the chamber 224 over the orifice 236.

FIG. 25 shows how the valve 220 is assembled. The valve 220, except for mouthpiece 228, is integrally formed in one piece from a resilient plastic material. Walls 252 and bottom 254 of the chamber 222 are connected to top 256 by hinge 258. Similarly, wall 244 and bottom 260 of the chamber 224 are connected to wall 250 of the chamber 224 by hinge 262. The wall 244 and bottom 260 are folded beneath the wall 250, as indicated by arrow 261, to form the chamber 224. The walls 252 and bottom 254 of the chamber 222 are folded beneath top 256 of the chamber 222, as indicated by arrow 263, with the strip 242 extending below bottom 260 and the valve member 234 extending into orifice 236. The mouthpiece 228 is attached to opening 264 in the top 256 of the chamber 222 after the valve 220 has been installed in the outer bag 232.

In operation of the valve 220, the user applies suction to the mouthpiece 228, creating a partial vacuum in the chambers 222 and 224. This partial vacuum causes the portion of the wall 230 of the outer bag 232 over the strip 248 to flex downward against the strip 248, thus moving the strip 248 and the valve member 234 out of sealing engagement with the orifice 236. A flow path for liquid in the outer bag 232 through the orifice 236 into chamber 224, through passage 226 into chamber 222 and into the mouthpiece 228 is created. When the user ceases applying the suction to the mouthpiece 228, the strip 242 biases the valve member 234 back into sealing engagement with the orifice 236 to close the valve 220.

It should now be readily apparent to those skilled in the art that a novel combination exercise and refreshment device capable of achieving the stated objects of the invention has been provided. The device of this invention provides both a substitute for hand held or wrist mounted, non-variable weights and a convenient way for a runner or other athlete to carry and drink water or other liquid while engaging in strenuous aerobic activities. As the water or other liquid is consumed or otherwise released during the exercise, the weight of the device is reduced, thus adjusting weight properly as the user becomes more fatigued.

It should further be apparent to those skilled in the art that various changes in form and detail of the invention as shown and described may be made. It is intended that such changes be included within the spirit and scope of the claims appended hereto.

What is claimed is:

1. A variable weight arm and shoulder exercise and personal refreshment device, comprising a liquid tight container dimensioned and configured to encircle closely a user's wrist and having a capacity to hold sufficient liquid when full to provide enhanced exercise to the user's arm and shoulder when the user's arm and shoulder are moved while said variable weight arm and shoulder exercise and personal refreshment device is worn by the user, said liquid tight container having an outerwall and an inner wall, a valve mounted on the outer wall, said valve extending through the outer wall to communicate with an interior of said liquid tight container, a mouthpiece at said valve to receive liquid through the valve, said mouthpiece being located on the outer wall over said valve, extending from the outer wall a sufficient distance for engagement by the user's mouth, terminating proximate to the outer wall and further being located so as to be accessible to the user by positioning the outer wall in front of the user's mouth with said device on the user's wrist, said valve being movable between an open and a closed position through application of force by the user's mouth on said mouthpiece, and means for fixedly attaching said liquid tight container in place encircling the user's wrist free of adjustment as liquid is withdrawn from the container through said valve and said mouthpiece by the user with said mouthpiece accessible to the user by positioning the outer wall in front of the user's mouth.

2. The variable weight arm and shoulder exercise and personal refreshment device of claim 1 in which said means for fixedly attaching said liquid tight container in place encircling the user's wrist comprises a flexible cylinder having open ends.

3. The variable weight arm and shoulder exercise and personal refreshment device of claim 2 in which said liquid tight container comprises a resilient bag attached to said flexible cylinder.

4. The variable weight arm and shoulder exercise and personal refreshment device of claim 3 in which said resilient bag is removably attached to said flexible cylinder by a base plate attached to said flexible cylinder with mating snap fit recesses and snaps.

5. The variable weight arm and shoulder exercise and personal refreshment device of claim 3 in which said resilient bag is removably attached to said flexible cylinder by a base plate attached to fabric loops fastener.

6. The variable weight arm and shoulder exercise and personal refreshment device of claim 3 additionally comprising at least one pocket on said flexible cylinder and at least one weight configured to be inserted in said at least one pocket.

7. The variable weight arm and shoulder and personal refreshment device of claim 2 in which said flexible cylinder includes a fold of fabric for expanding a diameter of said flexible cylinder and mating fastening means at opposite sides of said fabric fold for gathering said fabric fold together to reduce the diameter of said flexible cylinder.

8. The variable weight arm and shoulder and personal refreshment device of claim 3 in which said resilient bag has a fabric layer on an outer surface.

9. The variable weight arm and shoulder and personal refreshment device of claim 3 in which said resilient bag includes at least one thermal insulation layer to isolate the temperature of the liquid in said resilient bag from the wearer's body temperature and the ambient temperature.

10. The variable weight arm and shoulder and personal refreshment device of claim 3 in which said device includes a perspiration-absorbing layer between said resilient bag and the contact area of the wearer's wrist or forearm.

11. The variable weight arm and shoulder exercise and personal refreshment device of claim 3 in which said valve comprises a first chamber connected to said mouthpiece through said resilient bag outer wall, a second chamber connected by an orifice to said first chamber, said second chamber being connected to the interior of said resilient bag and a normally closed valve member sealingly engaging said orifice, said normally closed valve member being configured and positioned such that suction force on said mouthpiece will move said normally closed valve member out of engagement with said orifice to allow liquid in said resilient bag to pass through said first and second chambers to said mouthpiece.

12. The variable weight arm and shoulder exercise and personal refreshment device of claim 11 in which said valve is formed in a valve housing, said outer bag fitting over said valve housing, said first chamber being formed in part by an upper wall of said outer bag extending over a cavity in said valve housing, said valve member having a tip extending upward from said orifice toward the upper wall of said outer bag, the cavity and the tip of said valve member being configured so that suction on said mouthpiece will move the upper wall of said outer bag toward the tip of said valve member to move said valve member out of sealing engagement with said orifice.

13. The variable weight arm and shoulder exercise and personal refreshment device of claim 12 in which said housing and said normally closed valve member are integrally formed from a plastic material.

14. The variable weight arm and shoulder exercise and personal refreshment device of claim 13 in which said normally closed valve member is attached to said housing by a strip extending along said second chamber to said orifice, said strip urging said valve member into sealing engagement with said orifice.

15. The variable weight arm and shoulder and personal refreshment device of claim 11 in which said first and second chambers of said valve are laterally interconnected by a passage, said normally closed valve member is attached to a first resilient strip extending to said orifice, said normally closed valve member has a projecting tip extending through said orifice to engage a second resilient strip, said second resilient strip extending over said orifice, and said resilient bag outer wall engages said second resilient strip to bias said normally closed valve out of engagement with said orifice in response to partial vacuum created in said second chamber by the suction force.

16. The variable weight arm and shoulder and personal refreshment device of claim 15 in which said first and second chambers of said valve, said normally closed valve member and said first and second resilient strips are integrally formed from a plastic material.

17. The variable weight arm and shoulder exercise and personal refreshment device of claim 4 in which there are apertures at ends of said resilient bag and said resilient bag is attached to said base plate by a plurality of projections extending from said base plate through the apertures to hold the ends of said resilient bag together, and a removable cover having recesses configured for fixed engagement of the projections.

18. The variable weight arm and shoulder exercise and personal refreshment device of claim 17 in which the snap fit recesses are on said rigid plate and the snaps are on said flexible cylinder.

19. The variable weight arm and shoulder exercise and personal refreshment device of claim 1 including an electronic display device and an electronic circuit connected to said electronic display device, said electronic display device and said electronic current being mounted on said variable weight arm and shoulder exercise and personal refreshment device.

20. The variable weight arm and shoulder and personal refreshment device of claim 1 in which said device includes at least one retroreflective member attached to the outer wall.

21. The variable weight arm and shoulder exercise and personal refreshment device of claim 1 in which said means for fixedly attaching said liquid tight container in place encircling the user's wrist comprises an expandable resilient band attached to said liquid tight container, said expandable resilient band being dimensioned and configured to encircle the user's wrist concentrically with said liquid tight container beneath said liquid tight container between the user's wrist and the inner wall of said liquid tight container.

* * * * *